US012654981B1

(12) United States Patent
Wu

(10) Patent No.: US 12,654,981 B1
(45) Date of Patent: Jun. 16, 2026

(54) WIRE TAKE-UP DEVICE

(71) Applicant: Shenzhen Cirrus Innovation Technology Co., Ltd, Shenzhen (CN)

(72) Inventor: Minggui Wu, Shenzhen (CN)

(73) Assignee: Shenzhen Cirrus Innovation Technology Co., Ltd, Shenzhen (CN)

( * ) Notice: Subject to any disclaimer, the term of this patent is extended or adjusted under 35 U.S.C. 154(b) by 0 days.

(21) Appl. No.: 19/321,321

(22) Filed: Sep. 8, 2025

(30) Foreign Application Priority Data

Jul. 28, 2025 (CN) ..... 202511041742.3

(51) Int. Cl.
*B65H 75/44* (2006.01)

(52) U.S. Cl.
CPC . *B65H 75/4418* (2013.01); *B65H 2404/5331* (2013.01); *B65H 2701/34* (2013.01)

(58) Field of Classification Search
CPC .... H01R 13/72; H02G 11/02; B65H 75/4418; B65H 2701/34; B65H 2404/5331
USPC ..... 439/4, 164, 501, 862
See application file for complete search history.

(56) References Cited

U.S. PATENT DOCUMENTS 4,138,177 A * 2/1979 Van Valer ..... H02G 11/02 439/4
6,048,211 A * 4/2000 Liaom ..... H02G 11/02 439/4
7,452,249 B2 * 11/2008 Daily ..... H01R 12/725 439/825
7,588,441 B2 * 9/2009 Chang ..... H01R 13/2492 439/862
8,047,857 B1 * 11/2011 Lu ..... H01R 13/41 439/83
8,267,725 B2 * 9/2012 Zhu ..... H01R 13/41 439/862
8,956,194 B2 * 2/2015 Xie ..... H01R 12/716 439/862
8,974,257 B1 * 3/2015 Xie ..... H01R 12/57 439/862
9,017,116 B2 * 4/2015 Ando ..... H01R 13/113 439/862
12,255,475 B2 * 3/2025 Wei ..... H02J 7/0042
12,316,058 B1 5/2025 Xie et al.
(Continued)

FOREIGN PATENT DOCUMENTS

CN 220827110 U 4/2024
JP 2005243511 A 9/2005
(Continued)

*Primary Examiner* — Gary F Paumen

(57) ABSTRACT

A wire take-up device includes a shell having an internal cavity. The internal cavity is correspondingly provided with a wire take-up mechanism and a power transmission mechanism; the power transmission mechanism includes a movable plate member and a stationary plate member; the movable plate member is rotatably in electrical contact with the stationary plate member; a connector on the stationary plate member has a conductive contact formed by correspondingly bending a metal sheet; the conductive contact is in the shape of a spring arch, and is correspondingly pressed against the movable plate member to establish an electrical connection; and the conductive contact is configured to be thickened correspondingly at least at its deformation bending.

17 Claims, 8 Drawing Sheets

(56) References Cited

U.S. PATENT DOCUMENTS

| | | | | |
|---|---|---|---|---|
| 2013/0084734 | A1* | 4/2013 | Su | B65H 75/4434<br>439/501 |
| 2016/0043514 | A1* | 2/2016 | George | H01R 35/025<br>439/501 |

FOREIGN PATENT DOCUMENTS

| | | | |
|---|---|---|---|
| JP | 2007095349 | A | 4/2007 |
| WO | 2024125307 | A1 | 6/2024 |

* cited by examiner

WIRE TAKE-UP DEVICE

CROSS REFERENCE TO RELATED APPLICATIONS

The present application claims the benefit of Chinese Patent Application No. 202511041742.3 filed on Jul. 28, 2025, the contents of which are incorporated herein by reference in their entirety.

TECHNICAL FIELD

The present invention relates to the technical field of data wire take-up devices, and more particularly to a novel wire take-up device.

BACKGROUND

A wire take-up device, also known as a wire winder, a storage, or a take-up device, is designed to meet requirements for neat, portable, and safe use of connecting wires such as data cables. Currently, in order to save storage space and improve portability, charging data cables are stored in a take-up device from which the charging data cables are pulled out or retracted by a pulling action. The length of the charging data cable is adjusted according to usage needs, and different data interface types can be selected freely.

However, in most conventional charging data cable take-up devices available on the market, the connection configuration of the take-up mechanism and the power transmission mechanism is relatively complex and cumbersome, and the overall structure is diverse, which is not conducive to miniaturization and lightweight design of the device as a whole, and thus fails to meet application requirements in modern portable or space-constrained environments.

In particular, the conductive contacts formed by metal sheets in the power transmission mechanism not only have low pressure contact height, but also exhibit limited elasticity, which may easily lead to poor contact or even power interruption and like situations. Moreover, when a spring-like metal sheet is directly used as a conductive contact, it is frequently subjected to high-frequency bending, making it prone to metal fatigue, fracture, or increased resistance, thereby reducing product lifespan and operational reliability.

SUMMARY

In view of the above, it is an object of the present invention to provide a wire take-up device for solving the aforementioned problems.

The present invention employs the following solution.

The present application provides a novel wire take-up device, including a shell having an internal chamber, wherein the internal chamber is correspondingly provided with a wire take-up mechanism and a power transmission mechanism; the wire take-up mechanism is configured to store a connecting wire in a wire take-up groove within the internal chamber, and the shell is correspondingly formed at a side surface with an opening portion allowing the connecting wire to freely extend and retract, the opening portion being configured to allow the connecting wire to be pulled outward to extend a usable range of the connecting wire; the power transmission mechanism includes a movable plate member attached to the wire take-up mechanism, and a stationary plate member attached to the shell; and the movable plate member is rotatably in electrical contact with the stationary plate member, and the stationary plate member is provided with a plurality of connectors, the movable plate member is provided with at least one welding tray, and one end of the connecting wire is connected to the welding tray; and the connector has a plurality of conductive contacts formed by correspondingly bending a metal sheet; and each conductive contact is in a shape of a spring arch, and is correspondingly pressed against the movable plate member to establish electrical connection.

Preferably, each conductive contact is composed of a horizontal segment and an arcuate segment.

Preferably, the metal sheet is integrally bent at an obtuse angle along the horizontal segment to form the arcuate segment.

Preferably, an angle between the horizontal segment and the arcuate segment ranges from 140° to 150°.

Preferably, at least one arc-shaped bent portion and one hook-shaped pressing portion are provided on the arcuate segment, and a protruding rib portion with a thickened configuration is provided at least on the bent portion.

Preferably, the thickness of the metal sheet is between 0.09 mm and 0.15 mm, and the thickness of the protruding rib portion is between ⅓ and ½ of the thickness of the bent portion.

Preferably, the bent portion is integrally bent obliquely outward at an obtuse angle to form the pressing portion, and the protruding rib portion and the bent portion are of an integral structure and shape.

Preferably, the angle between the bent portion after horizontal bending-back extension and the pressing portion ranges from 100° to 110°.

Preferably, the pressing portion is provided with another protruding rib portion having a thickened configuration.

Preferably, the length of the protruding rib portion formed on the pressing portion is smaller than the length of the protruding rib portion formed on the bent portion, and the width of the protruding rib portion formed on the pressing portion is smaller than the width of the protruding rib portion formed on the bent portion.

Preferably, the plurality of conductive contacts includes at least three positive electrode contacts extending from one metal sheet and connected in parallel with each other, at least three negative electrode contacts extending from one metal sheet and connected in parallel with each other, and a signal transmission contact extending respectively from at least four metal sheets and connected in parallel with each other.

Preferably, the movable plate member is further provided with a plurality of input terminals for connecting to an external power source, and a conductive plate for electrically connecting to the connector.

Preferably, a plurality of annular conductive tracks are provided on the conductive plate, and the positive electrode contacts, negative electrode contacts, and signal transmission contact are rotatably abutting against the annular conductive tracks.

Preferably, another connector is correspondingly provided on the movable plate member, and another conductive plate is correspondingly provided on the stationary plate member for cooperating with another connector.

Preferably, the shell includes an upper shell and a lower shell snap-fitted with each other to form the internal chamber, an axial center is provided on the lower shell, a locking screw is provided on the upper shell, and at least two opening portions spaced apart from each other are provided on one side surface of the upper shell and the lower shell.

Preferably, the take-up mechanism includes an upper rubber core member and a lower rubber core member, and a spiral spring member; and the upper rubber core member and the lower rubber core member are oppositely arranged to form an accommodating chamber suitable for winding and placing the spiral spring member, and the wire take-up groove suitable for winding or unwinding the connecting wire.

Preferably, the stationary plate member is mounted on an inner wall of the upper shell, and the movable plate member is mounted on an outer wall of the upper rubber core member.

Preferably, the novel wire take-up device further includes a self-locking positioning mechanism, wherein the self-locking positioning mechanism includes a torsion spring provided on the inner wall of the upper shell.

Preferably, a plurality of detent grooves are correspondingly annularly arranged on an outer peripheral wall of the upper rubber core member and configured to abut against and cooperate with an extension arm of the torsion spring, and the extension arm of the torsion spring jumps from a previous detent groove to a next detent groove when the movable plate member rotates relative to the stationary plate member.

By using the above-mentioned technical solution, the present invention can achieve the following technical effects.

1. In the novel wire take-up device of the present application, a metal sheet correspondingly adopts a spring arch shaped conductive contact, along with thickening at the bent region, and enables the contact to maintain stable elastic force and contact pressure during prolonged reciprocally bending and pressing, effectively preventing metal fatigue fracture or increased contact resistance, thereby significantly improving the durability and reliability of the power transmission mechanism.

2. Each conductive contact is formed by simply bending a metal sheet and each conductive contact is provided in a spring arch shape, which not only provides a long effective spring height but also reduces the overall height of the metal sheet. While ensuring the electrical performance of the conductive element formed from the metal sheet, this design effectively disperses local stress, enhances overall stress resistance, and improves manufacturing yield and product service life.

3. Since the metal sheet of the connector is easy to stamp, bend, and weld, with a mature and low-cost manufacturing process, it facilitates mass production and assembly. The movable plate member and its welding tray are compactly integrated into the wire take-up mechanism, and the stationary plate member is compactly integrated within the shell, eliminating the need for additional space to accommodate independent power transmission components, which benefits the overall miniaturization and lightweight design of the wire take-up device. Additionally, the opening portion on the side face of the shell is formed in a structural shape suitable for the free entry and exit of the connecting wire, and cooperates with the internal wire take-up groove to smoothly guide the cable in and out. This ensures that the stored cable lies tightly against the shell, while allowing it to be easily pulled out for extended use when needed, thereby effectively reducing friction resistance and improving user experience.

BRIEF DESCRIPTION OF THE ACCOMPANYING DRAWINGS

ICONS

Figure 1:
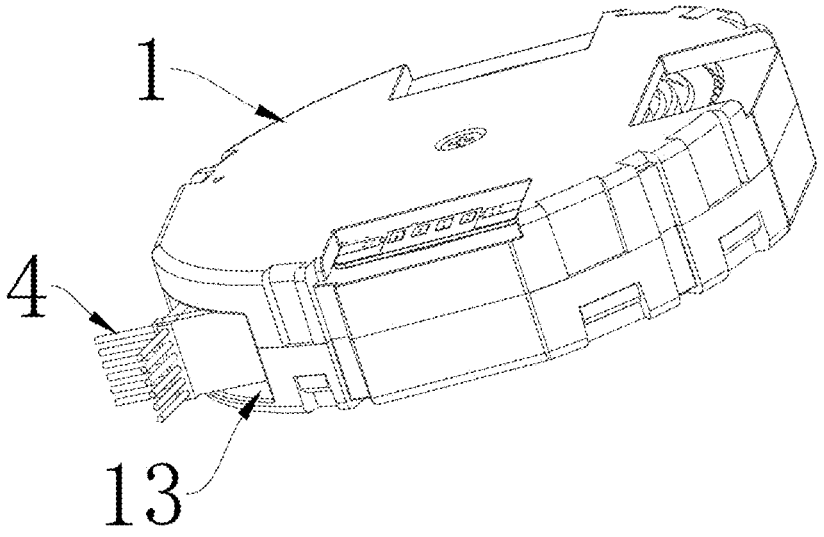
FIG. 1 is a schematic view illustrating a structure of a novel take-up device according to an embodiment of the present invention.

1—shell; 11—upper shell; 12—lower shell; 13—opening portion; 14—axial center; 15—locking screw; 2—wire take-up mechanism; 21—upper rubber core member; 22—lower rubber core member; 23—spiral spring member; 24 detent groove; 3—power transmission mechanism; 31—stationary plate member; 311—connector; 312—insulating material; 313—conductive contact; 314—horizontal segment; 315—arcuate segment; 316—bent portion; 317—pressing portion; 318—protruding rib portion; 313A—positive electrode contact; 313B—negative electrode contact; 313C—signal transmission contact; 32—movable plate member; 321—conductive plate; 322—welding tray; 4 connecting wire; 5—self-locking positioning mechanism; and 51—torsion spring.

DETAILED DESCRIPTION OF ILLUSTRATED EMBODIMENTS

To make the object, technical scheme, and advantage of the implementation modes of the present invention clearer, the technical scheme in the implementation modes of the present invention will be clearly and completely described below in conjunction with the accompanying drawings in the implementation modes of the present invention. Obviously, the described implementation modes are only a part of the implementation modes of the present invention, rather than all the implementation modes. Based on the implementation modes of the present invention, all other implementation modes obtained by one of ordinary skills in the art without involving any inventive efforts are within the scope of the present invention. Therefore, the following detailed description of the implementation modes of the present invention provided in the accompanying drawings is not intended to limit the scope of the invention as claimed, but is merely representative of selected implementation modes of the invention.

EMBODIMENTS

With reference to FIGS. 1 to 12, the present embodiment provides a novel wire take-up device including a shell 1 having an internal chamber. A wire take-up mechanism 2 and a power transmission mechanism 3 are respectively installed in the internal chamber. The wire take-up mechanism 2 is configured to store the connecting wire 4 within a wire take-up groove in the internal chamber, and the shell 1 is formed at a side surface with an opening portion 13 adapted for the connecting wire 4 to freely extend out of and retract into the shell, the opening portion 13 being configured to allow the connecting wire 4 to be pulled outward so as to extend the usable length of the connecting wire 4. The power transmission mechanism 3 includes a movable plate member 32 attached to the wire take-up mechanism 2 and a stationary plate member 31 attached to the shell 1. The movable plate member 32 is rotatably in electrical contact with the stationary plate member 31, a plurality of connectors 311 are provided on the stationary plate member 31, and at least one welding tray 322 is provided on the movable plate member 32. The welding tray 322 is connected in series with the connector 311, and one end of the connecting wire 4 is connected to the welding tray 322. The connector 311 has a plurality of conductive contacts 313 formed by correspondingly bending a metal sheet. Each conductive contact 313 is shaped as a spring arch and is pressed against the movable plate member 32 to establish an electrical connection. Each conductive contact 313 is configured to be correspondingly thickened at least at its deformation and bending region.

It needs to be noted that the term "spring arch shape" refers to a shape that is partially or entirely arcuate. The shape descriptions of various parts of the novel wire take-up device disclosed herein are provided merely for clarity of description and do not imply strict mathematical shape limitations of corresponding parts. These descriptions do not require that the actual shape and structure of the corresponding parts of the product in practical manufacturing and use exactly match the described mathematical technical features. In practical industrial applications, with regard to the product, reasonable deviations between the actual shape and structure and like features of the corresponding parts and the described shape features as defined may exist. The actual shape and configuration and like features of the corresponding parts of the novel wire take-up device disclosed in the present invention should be reasonably interpreted with reference to the accompanying drawings.

In the above-described novel wire take-up device, a metal sheet correspondingly adopts a spring arch shaped conductive contact 313, along with thickening at the bent region, and enables the contact to maintain stable elastic force and contact pressure during prolonged reciprocally bending and pressing, effectively preventing metal fatigue fracture or increased contact resistance, thereby significantly improving the durability and reliability of the power transmission mechanism 3.

Each conductive contact 313 is formed by simply bending a metal sheet and each conductive contact 313 is provided in a spring arch shape, which not only provides a long effective spring height but also reduces the overall height of the metal sheet. While ensuring the electrical performance of the conductive element formed from the metal sheet, this design effectively disperses local stress, enhances overall stress resistance, and improves manufacturing yield and product service life.

Since the metal sheet of the connector 311 is easy to stamp, bend, and weld, with a mature and low-cost manufacturing process, it facilitates mass production and assembly. The movable plate member 32 and its welding tray 322 are compactly integrated into the wire take-up mechanism 2, and the stationary plate member 31 is compactly integrated within the shell 1, eliminating the need for additional space to accommodate independent power transmission components, which benefits the overall miniaturization and lightweight design of the wire take-up device. Additionally, the opening portion 13 on the side face of the shell 1 is formed in a structural shape suitable for the free entry and exit of the connecting wire 4, and cooperates with the internal wire take-up groove to smoothly guide the cable in and out. This ensures that the stored cable lies tightly against the shell, while allowing it to be easily pulled out for extended use when needed, thereby effectively reducing friction resistance and improving user experience.

As shown in FIGS. 7 to 11, in this embodiment, each conductive contact 313 is composed of a horizontal segment 314 and an arcuate segment 315. At least one arc-shaped bent portion 316 and one hook-shaped pressing portion 317 are provided on the arcuate segment 315, and a protruding rib portion 318 with a thickened configuration is arranged on at least the bent portion 316 (the term "thickened configuration" means that the thickness of the protruding rib portion 318 is superimposed on the thickness of the bent portion 316, thereby increasing the overall thickness of the portion of the bent portion 316 corresponding to the protruding rib portion 318; and this will not be elaborated further herein). On one hand, the horizontal segment 314 provides an initial positioning platform, making it easier for a corresponding conductive contact 313 to maintain a reference position during assembly, while the arcuate segment 315 provides additional elastic deformation space besides the contact through its arc-shaped structure, generating a stable restoring force upon contact with the stationary plate member 31 and ensuring constant and repeatable contact pressure. On the other hand, the arc-shaped bent portion 316, having an attached protruding rib, increases the thickness of the spring sheet, thereby increasing the cross-sectional area in the stress concentration region, reducing the degree of local stress concentration, and significantly improving fatigue life under reciprocally repeated bending. In addition, the hook-shaped pressing portion 317 can form a local pre-pressing point at the end of the arcuate segment 315, resulting in more uniform overall force distribution, thereby preventing excessive stress on a single arcuate segment.

Specifically, the metal sheet is integrally bent at an obtuse angle along the horizontal segment 314 to form the arcuate segment 315, and the bent portion 316 is integrally bent at an obtuse angle obliquely outward to form the pressing portion 317. Bending along the horizontal segment 314 to form the arcuate segment 315, and then obliquely bending to form the pressing portion 317 are performed, with all bending angles being obtuse. This ensures a smoother transition from the horizontal segment 314 to the arcuate segment 315 and from the arcuate segment 315 to the pressing portion 317, thereby dispersing stress concentration, reducing the risk of local fatigue fracture, and enhancing the durability of a corresponding conductive contact 313 during repeated pressing contact cycles. Furthermore, the protruding rib portion 318 and the bent portion 316 have an integral structural shape. Clearly, the protruding rib portion 318 is integrally formed with the bent portion 316, which not only enhances the sectional rigidity of the bent region and further reduces deformation there under repeated deformation, but also increases the conductive cross-sectional area, thereby improving electrical conductivity and contact stability while maintaining mechanical strength.

Figure 10:
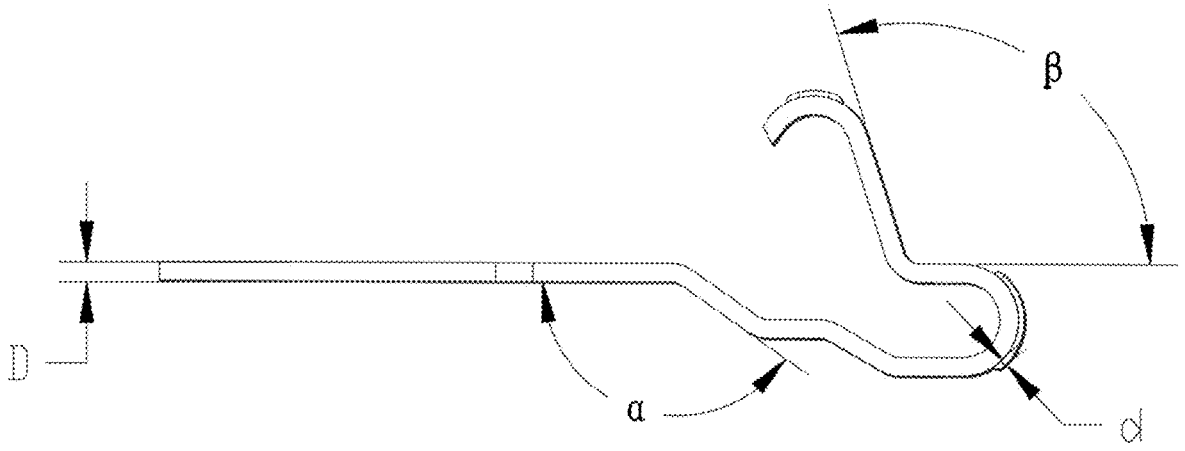
FIG. 10 is a schematic structural view of another dimensional parameter shown in FIG. 8.
Figure 11:
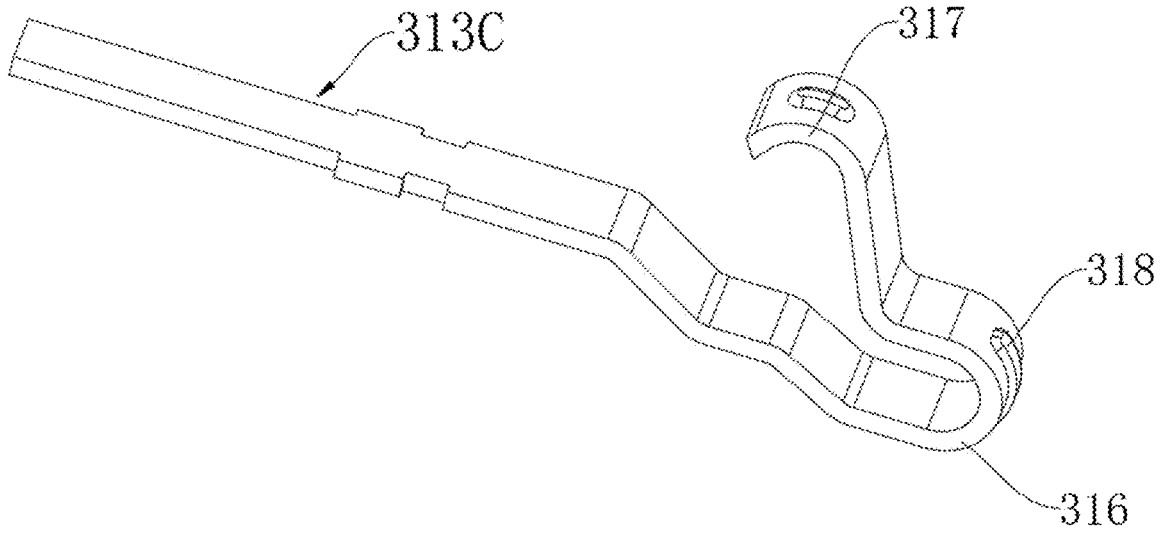
FIG. 11 is a schematic structural view of a signal transmission contact of FIG. 7.
Figure 12:
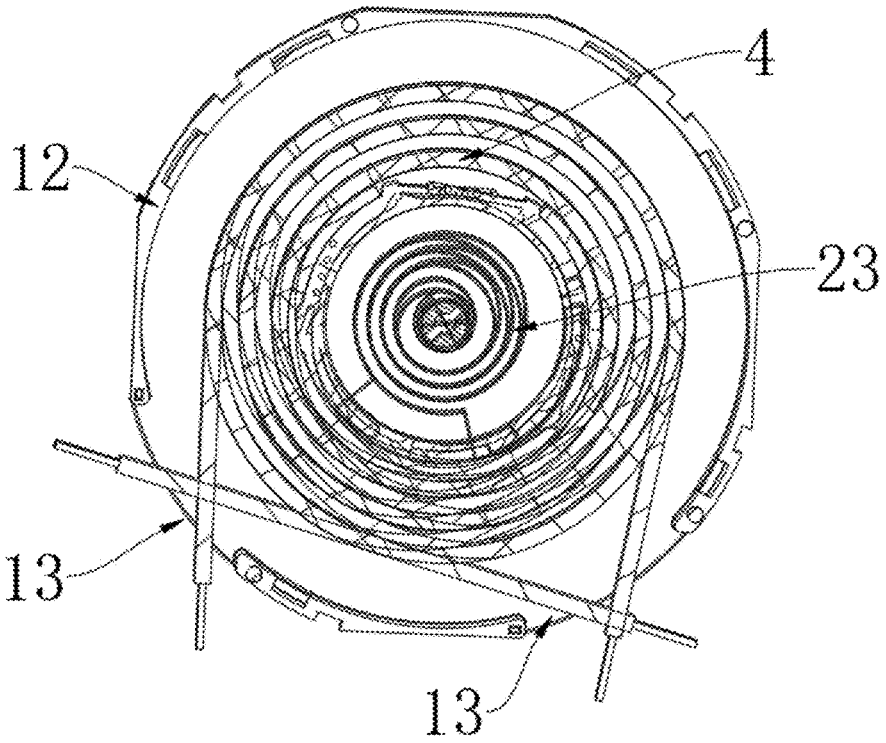
FIG. 12 is a cross-sectional view of a novel take-up device according to an embodiment of the present invention.

Preferably, the angle between the horizontal segment 314 and the arcuate segment 315 ranges from 140° to 150°, making the transition between the two more gradual, allowing sufficient elastic deformation under stress while avoiding excessive rigidity or stress concentration caused by overfolding, and thus achieving a stable and predictable restoring force. The angle between the bent portion 316 after horizontal bending-back extension and the pressing portion 317 ranges from 100° to 110°, enabling the pressing portion 317 to generate an appropriate initial deflection and maintain a large effective contact area when the pressing portion 317 presses against the stationary plate member 31, thereby ensuring a constant and sufficient contact pressure to overcome vibration and friction under various tensile conditions. As shown in FIG. 10, in the present embodiment, the angle α between the horizontal segment 314 and the arcuate segment 315 is 145° (angle α refers to the included angle formed by the horizontal direction at the end of the horizontal segment 314 connected to the arcuate segment 315, and the extending direction at the end of the arcuate segment 315 connected to the horizontal segment 314. Refer to the example of angle α shown in FIG. 10). The angle β between the bent portion 316 after the horizontal bending-back extension and the pressing portion 317 is 107° (angle β refers to the included angle formed by the extending direction of the bent portion 316 at the horizontally bending-back extending end, and the extending direction of the end of the pressing portion 317 connected to the horizontally bending-back extending end of the bent portion 316. Refer to the example of angle β shown in FIG. 10). As a result, the elastic height of the pressing portion 317 is increased to 0.8 mm, significantly improving the elastic height of the overall pressing portion 317 relative to the horizontal segment 314.

Preferably, the thickness of the metal sheet is 0.09 mm to 0.15 mm, and the thickness of the protruding rib portion 318 is between ⅓ and ½ of the thickness of the bent portion 316. It needs to be noted that the thickness of the metal sheet is controlled within 0.09 mm to 0.15 mm, for example, 0.09 mm, so that the entire conductive contact 313 has sufficient elastic deformability without being easily broken or losing the required deflection due to being too thin or too thick. The thickness of the protruding rib portion 318 is between ⅓ and ½ of the thickness of the bent portion 316, specifically 0.03 mm. By moderately thickening the protruding rib portion 318 at the location of the bent portion 316, the local stiffness and load-bearing capacity of this region are significantly enhanced, while the elastic characteristics of the overall arcuate segment 315 are maintained.

Figure 8:
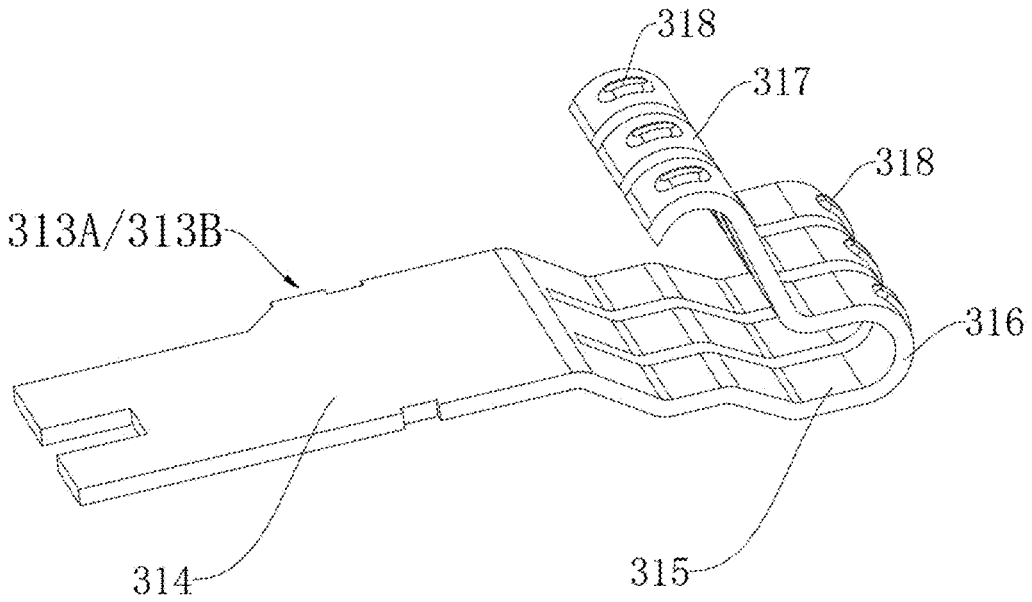
FIG. 8 is a schematic view of a structure of a positive electrode contact and a negative electrode contact of FIG. 7.

In one implementation mode, another protruding rib portion 318 with a thickening configuration is provided on the pressing portion 317 (as shown in FIG. 8, "thickening configuration" means that the thickness of the protruding rib portion 318 is superimposed on the thickness of the pressing portion 317, thereby increasing the overall thickness of the portion of the pressing portion 317 corresponding to the protruding rib portion 318. This will not be elaborated further). The length of the protruding rib portion 318 formed on the pressing portion 317 is smaller than the length of the protruding rib portion 318 formed on the bent portion 316, and the width of the protruding rib portion 318 formed on the pressing portion 317 is smaller than the width of the protruding rib portion 318 formed on the bent portion 316. Therefore, providing a smaller-sized protruding rib portion 318 on the pressing portion 317 is equivalent to adding a micro support point in the contact area, which not only maintains a low contact resistance during electrical contact, but also enables secondary fine adjustment of the contact pressure during pressing, resulting in more uniform and controllable contact force. The small protruding rib on the pressing portion 317 is smaller than the large protruding rib on the bent portion 316, ensuring that the main stress is still carried by the large protruding rib portion 318. While the small protruding rib on the pressing portion 317 serves as a micro buffer and stable guide, preventing unstable contact caused by a single contact point being too hard or too soft.

Figure 7:
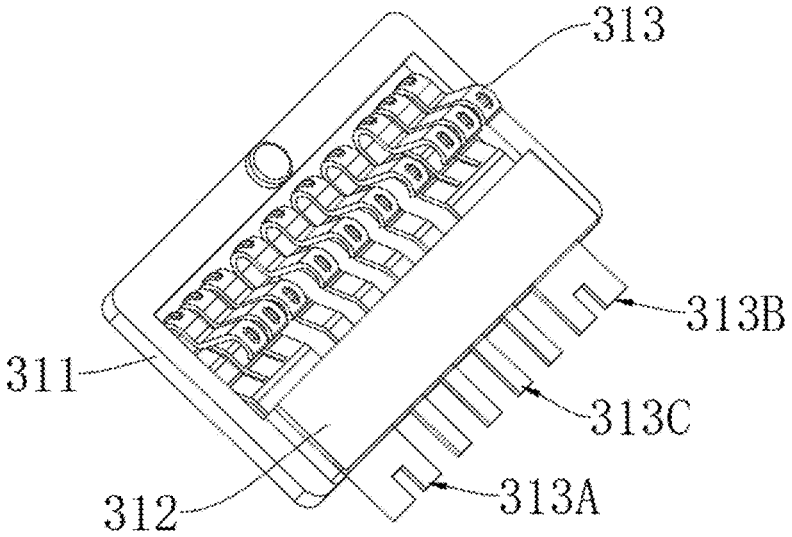
FIG. 7 is a schematic view illustrating a structure of a connector of a novel take-up device according to an embodiment of the present invention.

As shown in FIG. 7, in the present embodiment, the plurality of conductive contacts 313 includes at least three positive electrode contacts 313A extended from a single metal sheet and connected in parallel with each other, at least three negative electrode contacts 313B extended from a single metal sheet and connected in parallel with each other, and signal transmission contacts 313C extended respectively from at least four metal sheets and connected in parallel with each other. The movable plate member 32 is further provided with a plurality of input terminals (not shown) for connection to an external power source, and a conductive plate 321 for electrical connection with the connector 311. A plurality of annular conductive tracks are provided on the conductive plate 321, and the positive electrode contact 313A, the negative electrode contact 313B, and the signal transmission contact 313C are all rotatably in contact with the annular conductive tracks.

Obviously, in other implementation modes, a plurality of input terminals for connection to an external power source may also be provided on the stationary plate member 31, all falling within the scope of protection of the present invention.

It should be understood that, with regard to the various types of conductive contacts 313 on the connector 311, and the arrangement of the conductive plate 321 and conductive tracks thereon on the movable plate member 32, specific reference can be made to the prior art patent document with Chinese application number 202322261314.4, entitled "double-track double-positioning single-pull data wire telescopic line box" and therefore, no further description will be provided herein.

Figure 6:
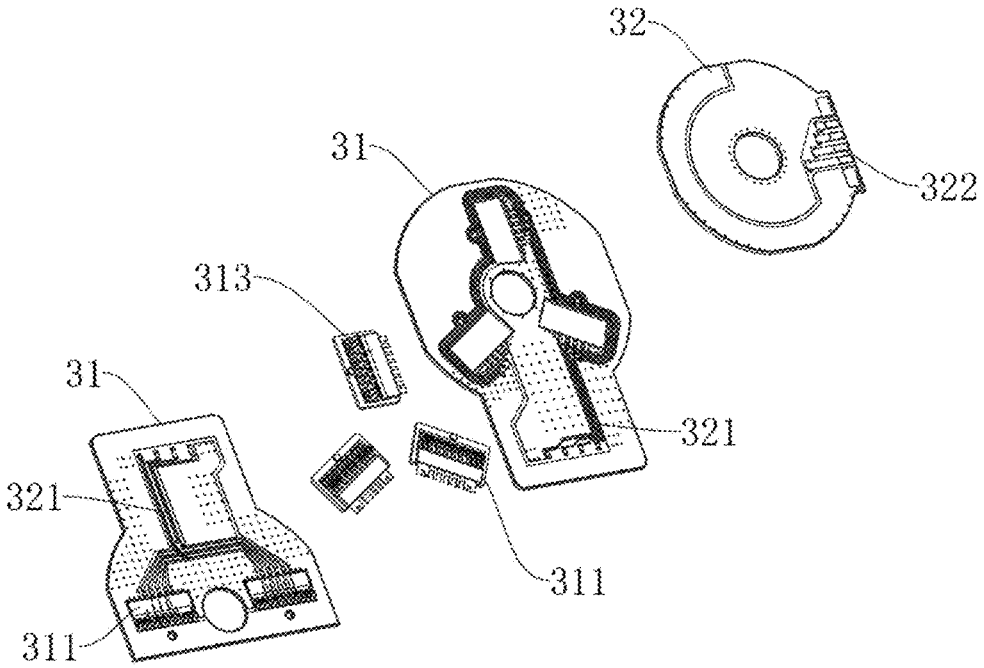
FIG. 6 is a schematic view showing a structure of a movable plate member and a stationary plate member of a novel take-up device according to the embodiment of the present invention.

In a preferred implementation mode, the movable plate member 32 is correspondingly provided with another connector 311, the stationary plate member 31 is correspondingly provided with another conductive plate 321 cooperating with the connector 311, and at least two stationary plate members 31 are provided (as shown in FIG. 6). Obviously, the specific structural configuration of the connector 311 and the conductive plate 321 may refer to the above-described connector 311 and conductive plate 321. In the power transmission mechanism 3, an additional pair of electrical connecting elements is introduced, allowing the current to be transmitted through the main connector (the connector 311 provided on the stationary plate member 31) and shared via the auxiliary connector (the connector 311 provided on the movable plate member 32). When contact resistance at one contact point increases due to wear or slight contamination, the other pair of contact points can still maintain stable conduction, significantly reducing the risk of single-point failure.

Figure 9:
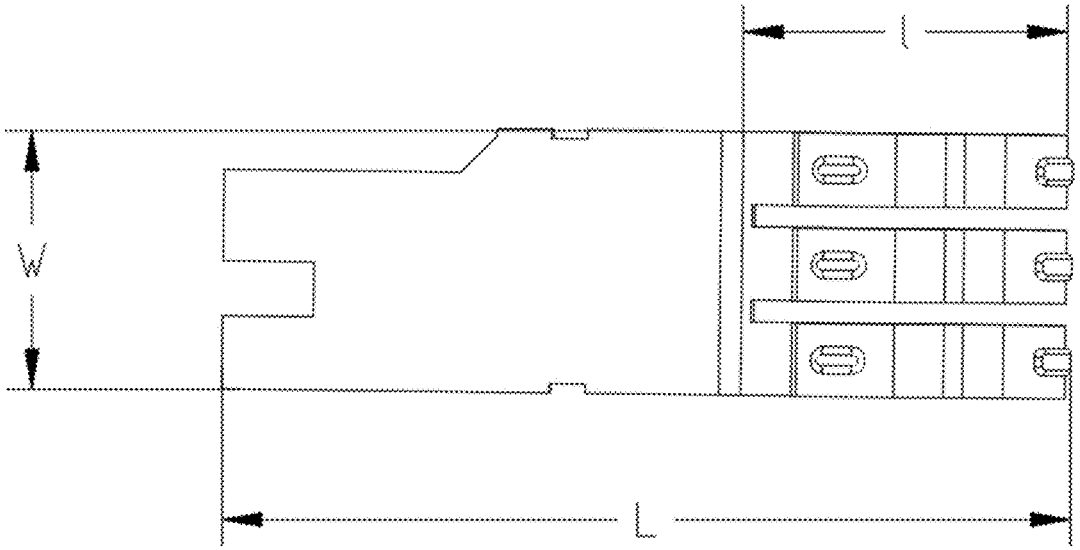
FIG. 9 is a schematic structural view of a dimensional parameter shown in FIG. 8.

As shown in FIGS. 8 to 10, in the present embodiment, the metal sheets of the positive electrode contact 313A and the negative electrode contact 313B are of the same specification and are arranged on the left side and right side of the insulating material 312 of the connector 311, respectively. The metal sheet of the signal transmission contact 313C has a thickness one-third that of the metal sheet of the positive electrode contact 313A or the negative electrode contact 313B, while other specifications are identical. Specifically, the parameters of the metal sheet of the positive electrode contact 313A or the negative electrode contact 313B are as follows: length L is 4.0 mm, width W is 1.2 mm, and thickness D is 0.09 mm. Furthermore, the length 1 of the arcuate segment 315 is 1.5 mm, and the thickness d of the protruding rib portion 318 is 0.03 mm. Similarly, the width of the metal sheet of the signal transmission contact 313C is 0.4 mm, and all other parameters are consistent with those of the metal sheet of the positive electrode contact 313A or the negative electrode contact 313B; and no further explanation is provided.

As shown in FIGS. 2 to 5, in the present embodiment, the shell 1 includes an upper shell 11 and a lower shell 12, which are snap-fitted to form the internal chamber. An axial center 14 is provided on the lower shell 12, a locking screw 15 is provided in the upper shell 11, and at least two spaced-apart opening portions 13 are provided on one side surface of the upper shell 11 and the lower shell 12. The snap-fit connection between the upper shell 11 and the lower shell 12 enables rapid assembly and disassembly of the wire take-up device, facilitating component replacement and maintenance during production and later maintenance.

Moreover, the axial center 14 built into the lower shell 12 provides a stable pivot point for the movable plate member 32 or the coil spiral spring member (hereinafter referred to as the spiral spring member 23), and the locking screw 15 on the upper shell 11 can securely lock the stationary plate member 31 and the axial center 14 of the lower shell 12, ensuring that the power transmission mechanism 3 does not become displaced or loosened during repeated reciprocating movements.

In addition, reserving two or more spaced-apart opening portions 13 on the same side surface allows multiple connecting lines 4 to be routed simultaneously, meeting requirements for multi-channel power or parallel signal lines, while it also enables flexible selection of opening positions based on actual usage conditions, thereby reducing the risk of friction and tangling of connecting lines 4 and other cables inside the shell 1.

Figure 2:
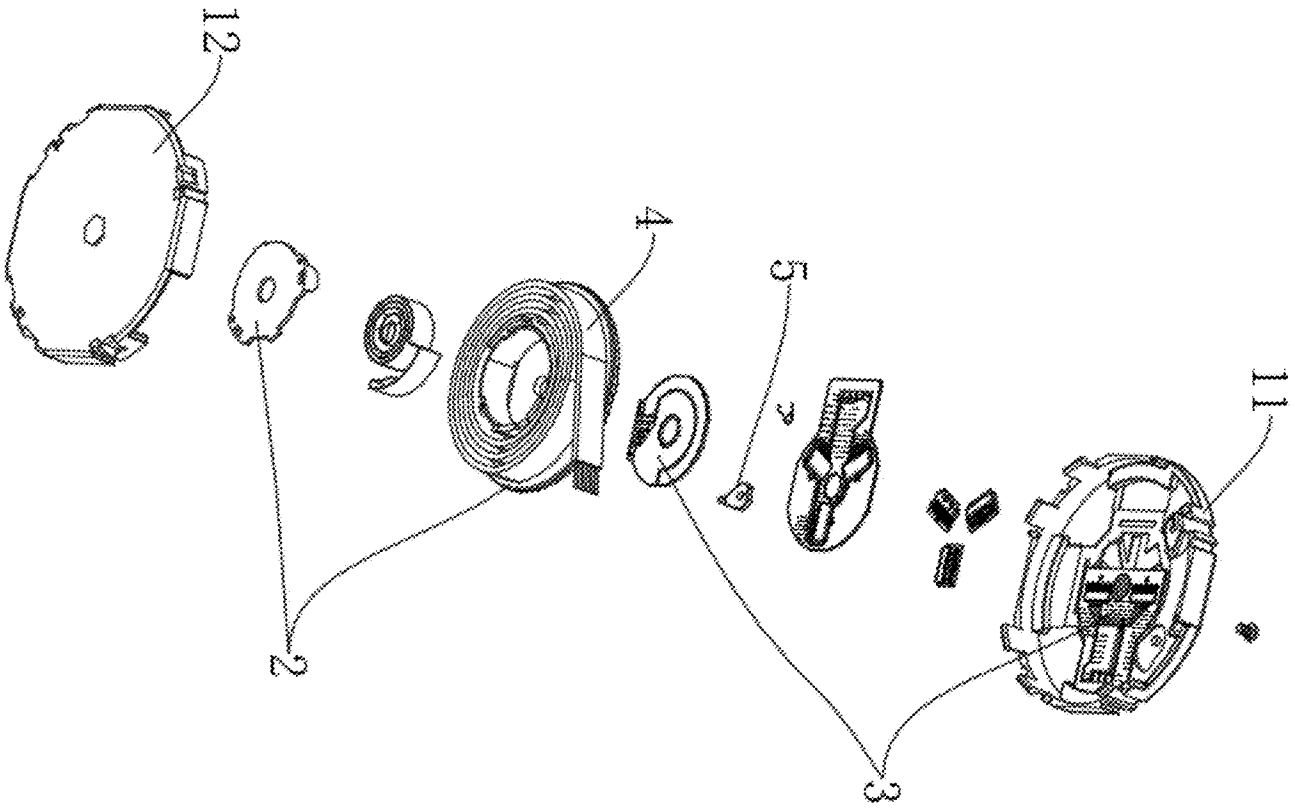
FIG. 2 is an exploded view of a novel take-up device according to an embodiment of the present invention.
Figure 3:
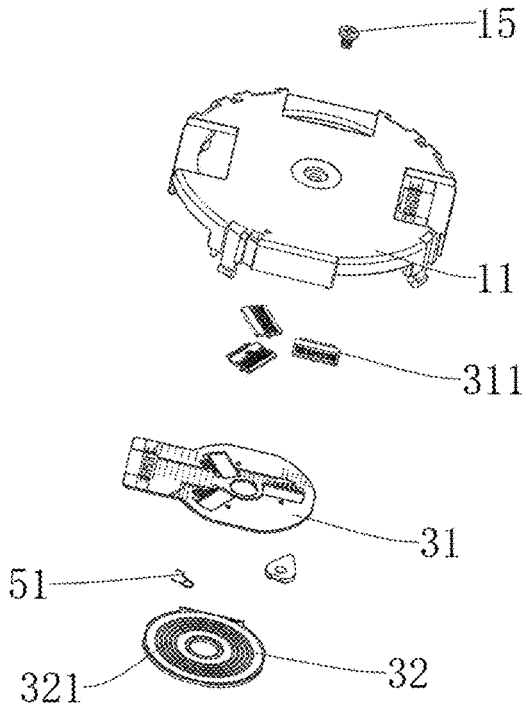
FIG. 3 is a schematic structural view of an upper half of FIG. 2.
Figure 4:
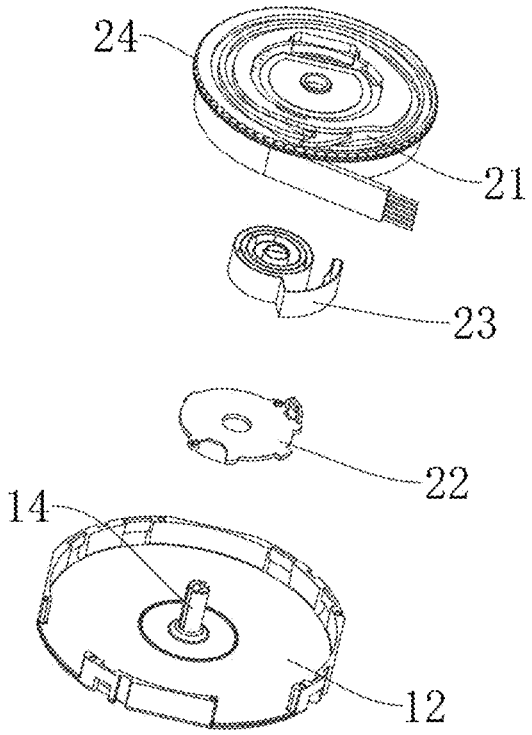
FIG. 4 is a schematic structural view of a lower half of FIG. 2.

As shown in FIGS. 2 and 4, in the present embodiment, the wire take-up mechanism 2 includes an upper rubber core member 21 and a lower rubber core member 22, as well as a spiral spring member 23. The upper rubber core member 21 and the lower rubber core member 22 are oppositely arranged to form a storage chamber (not shown) suitable for winding and accommodating the spiral spring member 23, and a take-up groove (not shown) suitable for winding or unwinding the connecting wire 4. The stationary plate member 31 is mounted on the inner wall of the upper shell 11, and the movable plate member 32 is mounted on the outer wall of the upper rubber core member 21.

It needs to be noted that, regarding the configuration of the wire take-up mechanism 2 and its wire take-up groove and spiral spring chamber, reference may be made to the prior art, Chinese patent application No. 202322261314.4, entitled "double-track double-positioning single-pull data wire telescopic line box", and thus will not be further described herein.

Figure 5:
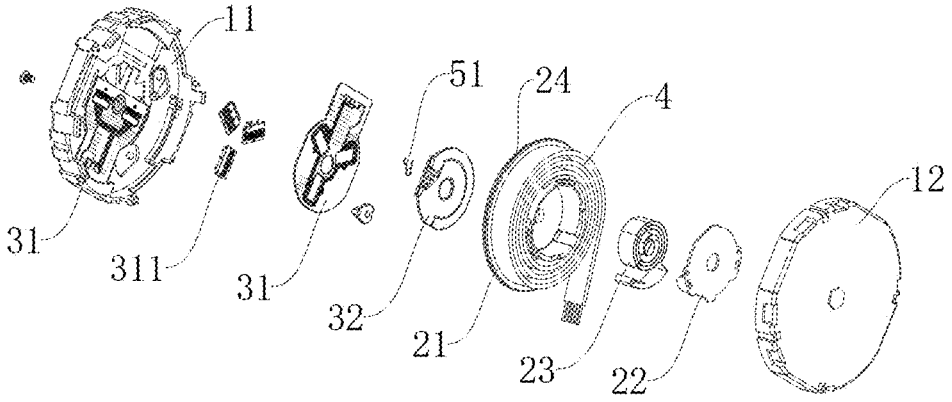
FIG. 5 is an exploded view of a novel take-up device according to an embodiment of the present invention.

As shown in FIGS. 4 and 5, in the present embodiment, the novel wire take-up device further includes a self-locking positioning mechanism 5. The self-locking positioning mechanism 5 includes a torsion spring 51 provided on the inner wall of the upper shell 11, and a plurality of detent grooves 24 are annularly provided on the outer peripheral wall of the upper rubber core member 21 and, abut against and are engaged with the extending arm of the torsion spring 51, such that when the movable plate member 32 rotates relative to the stationary plate member 31, the extending arm of the torsion spring 51 jumps from the last detent groove 24 to the next detent groove 24.

In the above self-locking positioning mechanism 5, the cooperation between the torsion spring 51 and the plurality of detent grooves 24 ensures that the movable plate member 32 is locked at each predetermined position during rotation, preventing the connecting wire 4 from self-unwinding due to external forces or elastic rebound, thereby achieving stable stepwise positioning. Each time jumping to one detent groove 24 is performed, the user can feel a distinct "click" feedback, and can freely hold the position at different gears, thereby improving controllability and usage comfort during the operation.

The above description is only a preferred embodiment of the present invention, and the scope of the present invention is not limited to the above-mentioned embodiments, and all technical solutions falling within the concept of the present invention fall within the scope of the present invention.

What is claimed is:

1. A wire take-up device, comprising a shell having an internal chamber, wherein the internal chamber is correspondingly provided with a wire take-up mechanism and a power transmission mechanism;

the wire take-up mechanism is configured to store a connecting wire in a wire take-up groove within the internal chamber, and the shell is correspondingly formed at a side surface with an opening portion allowing the connecting wire to freely extend and retract, the opening portion being configured to allow the connecting wire to be pulled outward to extend a usable range of the connecting wire;

the power transmission mechanism comprises a movable plate member attached to the wire take-up mechanism, and a stationary plate member attached to the shell; and the movable plate member is rotatably in electrical contact with the stationary plate member, and the stationary plate member is provided with a plurality of connectors, the movable plate member is provided with at least one welding tray, and one end of the connecting wire is connected to the welding tray; and wherein each connector has a plurality of conductive contacts formed by correspondingly bending a metal sheet; and each conductive contact is in a shape of a spring arch, and is correspondingly pressed against the movable plate member to establish an electrical connection;

wherein each conductive contact is composed of a horizontal segment and an arcuate segment, at least one arc-shaped bent portion and one hook-shaped pressing portion are provided on the arcuate segment, and a protruding rib portion with a thickened configuration is provided at least on the bent portion.

2. The wire take-up device according to claim 1, wherein the metal sheet is integrally bent at an obtuse angle along the horizontal segment to form the arcuate segment.

3. The wire take-up device according to claim 1, wherein an angle between the horizontal segment and the arcuate segment ranges from 140° to 150°.

4. The wire take-up device according to claim 1, wherein a thickness of the metal sheet is between 0.09 mm and 0.15 mm, and a thickness of the protruding rib portion is between ⅓ and ½ of a thickness of the bent portion.

5. The wire take-up device according to claim 1, wherein the bent portion is integrally bent obliquely outward at an obtuse angle to form the pressing portion, and the protruding rib portion and the bent portion are of an integral structure and shape.

6. The wire take-up device according to claim 5, wherein an angle between the bent portion after horizontal bending-back extension and the pressing portion ranges from 100° to 110°.

7. The wire take-up device according to claim 1, wherein the pressing portion is provided with another protruding rib portion having a thickened configuration.

8. The wire take-up device according to claim 7, wherein a length of the protruding rib portion formed on the pressing portion is smaller than a length of the protruding rib portion formed on the bent portion, and a width of the protruding rib portion formed on the pressing portion is smaller than a width of the protruding rib portion formed on the bent portion.

9. The wire take-up device according to claim 1, wherein the plurality of conductive contacts comprises at least three positive electrode contacts extending from one metal sheet and connected in parallel with each other, at least three negative electrode contacts extending from one metal sheet and connected in parallel with each other, and a signal transmission contact extending respectively from at least four metal sheets and connected in parallel with each other.

10. The wire take-up device according to claim 9, wherein the movable plate member is further provided with a plurality of input terminals for connecting to an external power source, and a conductive plate for electrically connecting to the connector.

11. The wire take-up device according to claim 10, wherein a plurality of annular conductive tracks are provided on the conductive plate, and the positive electrode contacts, negative electrode contacts, and signal transmission contact are rotatably abutting against the annular conductive tracks.

12. The wire take-up device according to claim 10, wherein another connector is correspondingly provided on the movable plate member, and another conductive plate is correspondingly provided on the stationary plate member for cooperating with the another connector.

13. The wire take-up device according to claim 1, wherein the shell comprises an upper shell and a lower shell snap-fitted with each other to form the internal chamber, an axial center is provided on the lower shell, a locking screw is provided on the upper shell, and at least two opening portions spaced apart from each other are provided on one side surface of the upper shell and the lower shell.

14. The wire take-up device according to claim 13, wherein the take-up mechanism comprises an upper rubber core member and a lower rubber core member, and a spiral spring member; and the upper rubber core member and the lower rubber core member are oppositely arranged to form an accommodating chamber suitable for winding and placing the spiral spring member, and the wire take-up groove suitable for winding or unwinding the connecting wire.

15. The wire take-up device according to claim 14, wherein the stationary plate member is mounted on an inner wall of the upper shell, and the movable plate member is mounted on an outer wall of the upper rubber core member.

16. The wire take-up device according to claim 15, further comprising a self-locking positioning mechanism, wherein the self-locking positioning mechanism comprises a torsion spring provided on the inner wall of the upper shell.

17. The wire take-up device according to claim 16, wherein a plurality of detent grooves are correspondingly annularly arranged on an outer peripheral wall of the upper rubber core member and configured to abut against and cooperate with an extension arm of the torsion spring, and the extension arm of the torsion spring jumps from a previous detent groove to a next detent groove when the movable plate member rotates relative to the stationary plate member.

* * * * *